US010253272B2

(12) United States Patent
Sun et al.

(10) Patent No.: US 10,253,272 B2
(45) Date of Patent: Apr. 9, 2019

(54) PROCESS FOR HYDROTREATING A RESIDUE STREAM

(71) Applicant: UOP LLC, Des Plaines, IL (US)

(72) Inventors: Ping Sun, Hinsdale, IL (US); Grant H. Yokomizo, Park Ridge, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/612,425

(22) Filed: Jun. 2, 2017

(65) Prior Publication Data

US 2018/0346829 A1 Dec. 6, 2018

(51) Int. Cl.
*C10G 67/00* (2006.01)

(52) U.S. Cl.
CPC ..... *C10G 67/00* (2013.01); *C10G 2300/107* (2013.01); *C10G 2300/1077* (2013.01); *C10G 2300/205* (2013.01); *C10G 2300/207* (2013.01); *C10G 2300/4081* (2013.01); *C10G 2300/42* (2013.01); *C10G 2300/805* (2013.01)

(58) Field of Classification Search
CPC ..... C10G 67/00; C10G 2300/805; C10G 2300/1077; C10G 2300/107; C10G 2300/207; C10G 2300/4081; C10G 2300/42; C10G 2300/205
See application file for complete search history.

(56) References Cited

U.S. PATENT DOCUMENTS 3,617,525 A 11/1971 Moritz et al.
3,767,569 A 10/1973 Mayer
3,876,530 A 4/1975 Prayer
4,340,466 A 7/1982 Inooka
4,401,561 A 8/1983 Thompson et al.
4,424,116 A 1/1984 Hettinger
4,556,540 A 12/1985 Benslay
5,334,307 A 8/1994 Simpson et al.
6,306,287 B1 10/2001 Billon et al.
6,576,121 B2 6/2003 Zeuthen et al.
7,575,670 B1 8/2009 Vanwees
(Continued)

FOREIGN PATENT DOCUMENTS

CN 103805233 A 5/2014
CN 102021021 A 9/2015
FR 2970478 B1 5/2014

OTHER PUBLICATIONS

Slain, Refining: Residue desulphurisation and conversion, Petroleum Technology Quarterly, vol. 11/(3), pp. 57-58, 60, 62-63 (2006).

(Continued)

*Primary Examiner* — Randy Boyer
*Assistant Examiner* — Juan C Valencia
(74) *Attorney, Agent, or Firm* — Paschall & Maas Law Office, LLC; James C. Paschall

(57) ABSTRACT

The subject process enhances catalytic activity for demetallization and desulfurization of a residue feed stream by injecting water into the feed and hydrotreating in two stages with interstage separation. Water injection improves the demetallation activity of the HDM catalyst and separating vapor comprising hydrogen sulfide from the demetallized effluent improves the activity of the HDS catalyst. We have discovered that the water injection and hydrogen sulfide removal together provide a profound synergetic effect.

18 Claims, 1 Drawing Sheet

(56) References Cited

U.S. PATENT DOCUMENTS

| | | | | |
|---|---|---|---|---|
| 8,394,262 | B2 | 3/2013 | Guichard et al. | |
| 8,435,400 | B2 * | 5/2013 | Kou | C10G 47/02 208/112 |
| 8,632,673 | B2 | 1/2014 | Kressmann et al. | |
| 9,334,452 | B2 | 5/2016 | Cash et al. | |
| 2004/0055934 | A1 | 3/2004 | Tromeur et al. | |
| 2008/0135450 | A1 | 6/2008 | Reynolds et al. | |
| 2011/0163004 | A1 | 7/2011 | Lourenco et al. | |
| 2014/0001089 | A1 | 1/2014 | Bazer-Bachi et al. | |
| 2014/0027351 | A1 | 1/2014 | Bazer-Bachi et al. | |
| 2014/0299515 | A1 | 10/2014 | Weiss et al. | |
| 2014/0332444 | A1 | 11/2014 | Weiss et al. | |

OTHER PUBLICATIONS

Tromeur, Hydroprocessing atmospheric and vacuum residues, Petroleum Technology Quarterly, vol. 51(1), pp. 21-23 (2000).

Franco, Heavy oil upgrading and enhanced recovery in a continuous steam injection process assisted by nanoparticulated catalysts , SPE Symposium on Improved Oil Recovery, v 2016—Jan. 2016, Society of Petroleum Engineers—SPE Improved Oil Recovery Conference; ISBN-13: 9781613994399; Conference: SPE Improved Oil Recovery Conference 2016, Apr. 11-13, 2016; Publisher: Society of Petroleum Engineers (SPE).

Sikonia, New data for RCD Unibon, Hydrocarbon Processing Jun. 1980, UOP Process Division, UOP Inc.

* cited by examiner

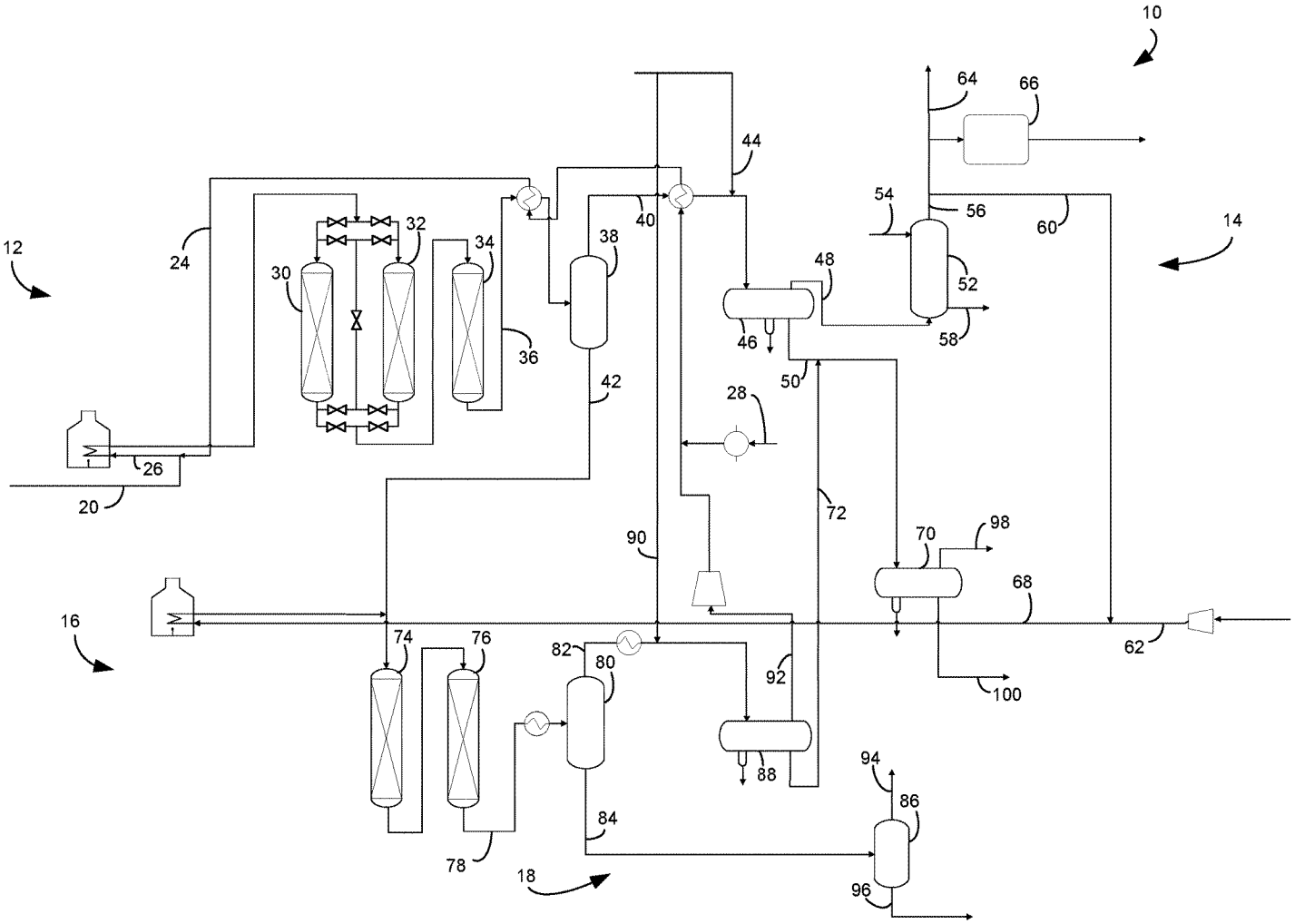
10
14
12
16
18
20
24
26
28
30
32
34
36
38
40
42
44
46
48
50
52
54
56
58
60
62
64
66
68
70
72
74
76
78
80
82
84
86
88
90
92
94
96
98
100

PROCESS FOR HYDROTREATING A RESIDUE STREAM

FIELD

The field is the hydrotreating of residue streams. Specifically, the field is the desulfurization of residue streams.

BACKGROUND

Hydroprocessing includes processes which convert hydrocarbons in the presence of hydroprocessing catalyst and hydrogen to more valuable products. Hydrotreating is a process in which hydrogen is contacted with a hydrocarbon stream in the presence of hydrotreating catalysts which are primarily active for the removal of heteroatoms, such as sulfur, nitrogen and metals, such as iron, nickel, and vanadium from the hydrocarbon feedstock.

Residue or resid streams are produced from the bottom of a fractionation column. Resid hydrotreating is a hydrotreating process to remove metals, sulfur and nitrogen from an atmospheric residue (AR) or a vacuum residue (VR) feed, so that it can be cracked to valuable fuel products.

Hydrotreating of resid streams requires high severity. Resid desulfurization units typically have hydrodemetallization (HDM) catalyst up front, followed by hydrodesulfurization (HDS) catalyst. Frequently, a resid hydrotreating unit is metal limited so the HDM catalyst is not fully utilized relative to its residual ability to hydrotreat more resid feed at the time of unit shutdown or turnaround. At the reactor inlet, HDM catalyst is fully adsorbed of metals where the feed metals are most concentrated. However, in downstream HDM catalyst beds, the lower concentration of metals in the feed operates to avoid full adsorption onto the HDM catalyst. Metal laying down on HDM catalyst causes the chemical reaction rate to decrease, which primarily occurs on the HDM catalyst surface. In practice, the reactor temperature is increased to compensate for the reaction rate decrease. Thus, when a portion of HDM catalyst in a demetallation reactor is saturated with metal, metals in the feed migrate to downstream HDS catalyst beds which affects HDS activity. In addition, coke buildup also affects reaction rate negatively across all catalyst beds. At a later stage of operation, metal breakthrough into downstream HDM catalyst starts to occur when temperature adjustment cannot compensate for the desulfurization reaction rate decrease. Consequently, the unit is shut down and the cycle is ended for replacement with fresh catalyst.

Refiners frequently desire a constant product quality in hydrotreated product below a certain sulfur specification. When a higher desulfurization reaction rate can be obtained and maintained throughout operation of a fixed unit cycle period, manifested as a consistent temperature profile along the unit cycle period, better product quality is achieved across the cycle for the same volume of catalyst.

It would be highly desirable to have a hydrotreating process that can efficiently demetallize and desulfurize a resid stream.

BRIEF SUMMARY

The subject process enhances catalytic activity for demetallization and desulfurization of a residue feed stream by injecting water into the feed and hydrotreating in two stages with interstage separation. Water injection improves the desulfurization activity of the HDM catalyst and separating vapor comprising hydrogen sulfide from the demetallized effluent before entering the desulfurization reactor improves the activity of the HDS catalyst. We have discovered that the water injection and hydrogen sulfide removal together provide a profound synergetic effect.

BRIEF DESCRIPTION OF THE DRAWING

The FIGURE is a schematic drawing of a two-stage hydrocracking unit.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Absorber and scrubbing columns do not include a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The overhead pressure is the pressure of the overhead vapor at the vapor outlet of the column. The bottom temperature is the liquid bottom outlet temperature. Overhead lines and bottoms lines refer to the net lines from the column downstream of any reflux or reboil to the column unless otherwise indicated. Stripping columns omit a reboiler at a bottom of the column and instead provide heating requirements and separation impetus from a fluidized inert vaporous media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-7169.

As used herein, the term "T5", "T70" or "T95" means the temperature at which 5 mass percent, 70 mass percent or 95 mass percent, as the case may be, respectively, of the sample boils using ASTM D-7169.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at higher pressure.

DETAILED DESCRIPTION

The subject process and apparatus enhances catalytic activity for demetallization and desulfurization of a residue feed stream by injecting water into the feed and hydrotreating in two stages with interstage separation between demetallation and desulfurization stages. The apparatus and process 10 for hydrotreating a hydrocarbon resid stream comprises a first stage hydrotreating unit 12, a first stage separation section 14, a second stage hydrotreating unit 16 and a second stage separation section 18.

A hydrocarbon resid stream in resid line 20 and a first stage hydrogen stream in a first hydrogen line 24 are fed to the first stage hydrotreating unit 12. A stream of water in water feed line 28 is also delivered to the first stage hydrotreating unit 12. The stream of water may comprise 0.5 to about 6 wt % and preferably about 3 to about 5.5 wt % water based on the weight of the resid hydrocarbon stream in resid line 20. In an aspect, the water stream may be added or pumped into the first stage hydrogen stream in the first stage hydrogen line 24 to mix the streams. Mixing makes the hydrogen stream include about 0.5 to about 6 wt % water based on the weight of the resid hydrocarbon stream in resid line 20. The stream of water may be provided from boiler feed water which is condensed from steam and therefore comprises little or no salts.

In one aspect, the process and apparatus described herein are particularly useful for hydrotreating a hydrocarbon feed stream comprising a resid hydrocarbonaceous feedstock. A resid feedstock may be taken from a bottom of an atmospheric fractionation column or a vacuum fractionation column. A suitable resid feed is AR having an T5 between about 316° C. (600° F.) and about 399° C. (750° F.) and a T70 between about 510° C. (950° F.) and about 704° C. (1300° F.). VR having a T5 in the range between about 482° C. (900° F.) and about 565° C. (1050° F.) may also be a suitable feed. VR, atmospheric gas oils having T5 between about 288° C. (550° F.) and about 315° C. (600° F.) and vacuum gas oils (VGO) having T5 between about 316° C. (600° F.) and about 399° C. (750° F.) may also be blended with the AR to make a suitable resid feed. Deasphalted oil, visbreaker bottoms, clarified slurry oils, and shale oils may also be suitable resid feeds alone or by blending with AR or VR.

Typically these resid feeds contain a significant concentration of metals which have to be removed before catalytic desulfurization can occur because the metals will adsorb on the HDS catalyst making it inactive. Typically, suitable resid feeds include about 50 to about 500 wppm metals but resid feeds with less than about 200 wppm metals may be preferred. Nickel, vanadium and iron are some of the typical metals in resid feeds. Resid feeds may comprise about 5 to about 200 wppm nickel, about 50 to about 500 wppm vanadium, about 1 to about 150 wppm iron and/or about 5 to about 25 wt % Conradson carbon residue. Resid feeds may comprise about 10,000 wppm to about 60,000 wppm sulfur. Frequently refiners have a targeted product specification depending on downstream application of hydrotreated products, primarily on sulfur and metal content.

The first stage hydrogen stream in the first hydrogen line 24 may join the resid stream in the resid line 20 to provide a resid feed stream in a resid feed line 26. The resid feed stream in the resid feed line 26 may be heated in a fired heater. The heated resid feed stream in the resid feed line 26 may be fed to a first resid hydrotreating unit 12. With the water stream from line 28 added to the first stage hydrogen stream in line 24, the first stage hydrogen stream, the water stream and the resid feed stream in line 20 may all be heated together in the fired heater in resid feed line 26.

Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. The first hydrotreating unit 12 may comprise three demetallizing reactors comprising a first demetallizing reactor 30, a second demetallizing reactor 32 and a third demetallizing reactor 34. More or less demetallizing reactors may be used, and each demetallizing reactor 30, 32 and 34 may comprise a part of a demetallizing reactor or comprise one or more demetallizing reactors. Each demetallizing reactor 30, 32 and 34 may comprise part of a catalyst bed or one or more catalyst beds in one or more demetallizing reactor vessels. In the FIGURE, the first hydrotreating unit 12 comprises three demetallizing reactors 30, 32 and 34 each comprising a single bed of HDM catalyst.

Multiple demetallizing reactors 30, 32, 34 may also include demetallizing reactors operating in swing bed mode and/or in lead-lag mode. In one aspect, the first demetallizing reactor 30 and the second demetallizing reactor 32 may operate in swing bed and/or in lead lag mode. In an embodiment, the first demetallizing reactor 30 and the second demetallizing reactor 32 are in series with the first demetallizing reactor 30 in the lead and the second demetallizing reactor 32 in the lag, downstream of the first demetallizing reactor 30. The second demetallizing reactor 32 may be switched to the lead when the first demetallizing reactor 30 is shut down for catalyst replacement or regeneration. In this embodiment, the second demetallizing reactor 32 may stay in the lead even after the first demetallizing reactor 30 is brought back on stream in the lag, downstream of the second demetallizing reactor 30. The second demetallizing reactor 32 may stay in the lead until it is shut down for catalyst replacement or regeneration, in which case the first demetallizing reactor 32 is returned to the lead as the cycle resumes. The third demetallizing reactor 34 may also be operated in the lead-lag cycle with the first demetallizing reactor 30 and the second demetallizing reactor 32 or not.

Suitable HDM catalysts for use in the first resid hydrotreating unit 12 are any conventional resid hydrotreating catalysts and include those which are comprised of at least one Group VIII metal, preferably iron, cobalt and nickel, more preferably nickel and/or cobalt and at least one Group VI metal, preferably molybdenum and tungsten, on a high surface area support material, preferably alumina. It is within the scope of the present invention that more than one type of hydrotreating catalyst be used in the same reaction vessel or catalyst bed. The Group VIII metal is typically present on the HDM catalyst in an amount ranging from about 1 to about 10 wt %, preferably from about 2 to about 5 wt %. The Group VI metal will typically be present on the HDM catalyst in an amount ranging from about 1 to about 20 wt %, preferably from about 2 to about 10 wt %.

In an embodiment, the first demetallation reactor 30, the second demetallation reactor 32 and the third demetallation reactor 34 may comprise a HDM catalyst comprising cobalt and molybdenum on gamma alumina. The HDM catalyst in the first demetallation reactor 30, the second demetallation reactor 32 and the third demetallation reactor 34 may have a bimodal pore size distribution with at least about 25% of the pores on the catalyst particle being characterized as small pores, in the micropore or mesopore range of about 5 to no more than about 30 nm and at least about 25% of the pores being characterized as large pores, in the mesopore or macropore range of greater than about 30 to about 100 nm. The large pores are more suited for demetallation and the small pores are more suited for desulfurization. The ratio of large pores to small pores may decrease from upstream to downstream in the first demetallation reactor 30, the second demetallation reactor 32 and the third demetallation reactor 34. In an aspect, the first demetallation reaction 30 will have a larger ratio of large pores to small pores than the second demetallation reactor 32. In a further aspect, the second demetallation reaction 32 will have a larger ratio of large pores to small pores than the third demetallation reactor 34.

The resid feed stream in line 26 may be fed to the first demetallation reactor 30, the second demetallation reactor 32 and the third demetallation reactor 34. The first demetallation reactor 30, the second demetallation reactor 32 and the third demetallation reactor 34 may be arranged in series such that the effluent from one cascades into the inlet of the other. It is contemplated that more or less demetallation reactors may be provided in the first stage hydrotreating unit 12. The first demetallation reactor 30, the second demetallation reactor 32 and the third demetallation reactor 34 are intended to demetallize the heated resid stream, so to reduce the metals concentration in the fresh feed stream by about 40 to about 100 wt % and typically about 65 to about 95 wt % to produce a demetallized effluent stream exiting one, some or all of the first demetallation reactor 30, the second demetallation reactor 32 and the third demetallation reactor 34. The metal content of the demetallized resid stream may be less than about 50 wppm and preferably between about 1 and about 25 wppm. The first demetallation reactor 30, the second demetallation reactor 32 and the third demetallation reactor 34 may also desulfurize and denitrogenate the resid stream. A demetallized resid stream reduced in metals and sulfur concentration relative to the resid feed stream fed to the reactor may exit first demetallation reactor 30, the second demetallation reactor 32 and the third demetallation reactor 34.

Preferred reaction conditions in each of the first demetallation reactor 30, the second demetallation reactor 32 and the third demetallation reactor 34 include a temperature from about 66° C. (151° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig) to about 27.6 MPa (gauge) (4000 psig), preferably about 13.8 MPa (gauge) (2000 psig) to about 20.7 MPa (gauge) (3000 psig), a liquid hourly space velocity of the fresh resid feed from about 0.1 $hr^{-1}$ to about 5 $hr^{-1}$, preferably from about 0.2 to about 2 $hr^{-1}$, and a hydrogen rate of about 168 $Nm^3/m^3$ (1,000 scf/bbl) to about 1,680 $Nm^3/m^3$ oil (10,000 scf/bbl), preferably about 674 $Nm^3/m^3$ oil (4,000 scf/bbl) to about 1,011 $Nm^3/m^3$ oil (6,000 scf/bbl).

The first stage demetallized resid stream may exit the third demetallation reactor 34 or whichever demetallation reactor 30, 32, 34 is the last on stream in the first demetallized effluent line 36, be cooled by heat exchange with the first stage hydrogen stream in line 24 and enter the first stage separation section 14 comprising a first stage hot separator 38. The first stage separation section 14 comprises one or more separators in downstream communication with the first hydrotreating unit 12 including the first stage hot separator 38. The first demetallized effluent line 36 delivers a cooled demetallized effluent stream to the first stage hot separator 38. Accordingly, the first stage hot separator 38 is in downstream communication with the first demetallation reactor 30, the second demetallation reactor 32 and the third demetallation reactor 34.

The first stage hot separator 38 separates the demetallized resid stream to provide a hydrocarbonaceous, first stage vapor stream in a first hot overhead line 40 and a hydrocarbonaceous, first stage hot liquid stream in a first hot bottoms line 42. The first stage vapor stream comprises the bulk of the hydrogen sulfide from the demetallized resid stream. The first stage liquid stream has a smaller concentration of hydrogen sulfide than the desulfurized resid stream. A second stage hydrogen stream may be taken from the first stage vapor stream in line 40.

The first stage hot separator 38 may operate at about 177° C. (350° F.) to about 371° C. (700° F.) and preferably operates at about 232° C. (450° F.) to about 315° C. (600° F.). The first stage hot separator 38 may be operated at a slightly lower pressure than the first desulfurization reactor 34 accounting for pressure drop through intervening equipment. The first stage hot separator 38 may be operated at pressures between about 3.4 MPa (gauge) (493 psig) and about 20.4 MPa (gauge) (2959 psig). The hydrocarbonaceous, first stage vapor stream in the hot overhead line 40 may have a temperature of the operating temperature of the first stage hot separator 38. The first stage hot liquid stream in the first hot bottoms line 42 may be mixed with a second stage hydrogen stream in a second hydrogen line 68 and be fed to the second hydrotreating unit 16.

The first stage hot vapor stream in the first hot overhead line 40 may be cooled by heat exchange with the first stage hydrogen stream in line 24 before entering a first stage cold separator 46. The first stage cold separator 46 may be in downstream communication with the hot overhead line 40.

As a consequence of the reactions taking place in the first stage hydrotreating unit 12 wherein nitrogen, chlorine and sulfur are reacted from the feed, ammonia and hydrogen sulfide are formed. The first stage hot separator 38 removes the hydrogen sulfide and ammonia from the first stage liquid stream in the first hot bottoms line 42 into the first stage vapor stream in the hot overhead line 40 to provide a sweetened, demetallized resid stream for desulfurization in the second hydrotreating unit 16.

At a characteristic sublimation temperature, ammonia and hydrogen sulfide will combine to form ammonium bisulfide and ammonia, and chlorine will combine to form ammonium chloride. Each compound has a characteristic sublimation temperature that may allow the compound to coat equipment, particularly heat exchange equipment, impairing its performance. To prevent such deposition of ammonium bisulfide or ammonium chloride salts in the first hot overhead line 40 transporting the first stage vapor stream, a suitable amount of wash water may be introduced into the first hot overhead line 40 by a first water wash line 44.

The cooled first stage vapor stream may be separated in the cold separator 46 to provide a first stage cold vapor stream comprising a hydrogen-rich gas stream including ammonia and hydrogen sulfide in a first cold overhead line 48 and a first stage cold liquid stream in a first cold bottoms line 50. The cold separator 46 serves to separate hydrogen rich gas from hydrocarbon liquid in the first stage hot vapor stream for recycle to the second stage hydrotreating unit 16. The first stage cold separator 46, therefore, is in downstream communication with the first hot overhead line 40 of the first stage hot separator 38.

The cold separator 46 may be operated at about 100° F. (38° C.) to about 150° F. (66° C.), suitably about 115° F. (46°

C.) to about 145° F. (63° C.), and just below the pressure of the last demetallation reactor 30, 32, 34 and the first stage hot separator 38 accounting for pressure drop through intervening equipment to keep hydrogen and light gases in the overhead and normally liquid hydrocarbons in the bottoms. The first stage cold separator 46 may be operated at pressures between about 3 MPa (gauge) (435 psig) and about 20 MPa (gauge) (2,901 psig). The first stage cold separator 46 may also have a boot for collecting an aqueous phase. The first stage cold liquid stream in the first cold bottoms line 50 may have a temperature of the operating temperature of the cold separator 46. The first stage cold liquid stream in the first cold bottoms line 50 may be delivered to a cold flash drum 70, in an embodiment after mixing with a second stage cold liquid stream in a second cold bottoms line 72. The cold flash drum 70 may be in downstream communication with the first cold bottoms line 50 of the first cold separator 46.

The first stage cold vapor stream in the first cold overhead line 48 is rich in hydrogen. Thus, hydrogen can be recovered from the first stage cold vapor stream. However, this stream comprises much of the hydrogen sulfide and ammonia separated from the demetallized resid stream. The cold vapor stream in the cold overhead line 48 may be passed through a trayed or packed recycle scrubbing column 52 where it is scrubbed by means of a scrubbing extraction liquid such as an aqueous solution fed by line 54 to remove and acid gases including hydrogen sulfide and carbon dioxide by extracting them into the aqueous solution. Preferred aqueous solutions include lean amines such as alkanolamines DEA, MEA, and MDEA. Other amines can be used in place of or in addition to the preferred amines. The lean amine contacts the first stage cold vapor stream and absorbs acid gas contaminants such as hydrogen sulfide and carbon dioxide. The resultant "sweetened" first stage cold vapor stream is taken out from an overhead outlet of the recycle scrubber column 52 in a recycle scrubber overhead line 56, and a rich amine is taken out from the bottoms at a bottom outlet of the recycle scrubber column in a recycle scrubber bottoms line 58. The spent scrubbing liquid from the bottoms may be regenerated and recycled back to the recycle scrubbing column 52 in line 54. The scrubbed hydrogen-rich stream emerges from the scrubber via the recycle scrubber overhead line 56 and a recycle portion in recycle line 60 may be added to the make-up hydrogen stream in make-up line 62 for supplying a second stage hydrogen stream in second hydrogen line 68 to the second stage hydrotreating unit 16. Accordingly, the second stage hydrogen stream in second hydrogen line 68 may be taken from the first stage vapor stream in the hot overhead line 40 and the first stage cold vapor stream in the first stage cold overhead line 48. Another portion of the scrubbed hydrogen-rich stream in the recycle scrubber overhead line 56 may be purged in line 64 and/or forwarded to a hydrogen recovery unit 66. The recycle scrubbing column 52 may be operated with a gas inlet temperature between about 38° C. (100° F.) and about 66° C. (150° F.) and an overhead pressure of about 3 MPa (gauge) (435 psig) to about 20 MPa (gauge) (2900 psig).

A demetallized first stage liquid stream exits the first hydrotreating unit 12 and the first stage separation section 14 in the first stage liquid stream transported in the first hot liquid line 42 with a reduced concentration of metals, sulfur and nitrogen relative to the resid stream in line 20. The second stage hydrogen stream in second hydrogen line 68 is heated in a fired heater and mixed with the demetallized resid stream in the first hot separator bottoms line 42 and fed to the second hydrotreating unit 16. The first stage liquid stream is still at elevated temperature and may not need further heating before entering the second stage hydrotreating unit 16. In an embodiment, the second hydrotreating unit 16 comprises a first desulfurization reactor 74 and a second desulfurization reactor 76 which may include a hydrodesulfurization (HDS) catalyst. More or less desulfurization reactors may be used. The HDS catalyst may comprise nickel or cobalt and molybdenum on gamma alumina to convert organic sulfur to hydrogen sulfide. The HDS catalyst may have a monomodal distribution of mesoporous pore sizes with at least 50% of the pores on the catalyst particle being in the range of 10-50 nm. The first desulfurization reactor 74 and the second desulfurization reactor 76 may be operated in series with the effluent from the first desulfurization reactor 74 cascading into an inlet of the second desulfurization reactor 76. The first desulfurization reactor 74 and the second desulfurization reactor 76 desulfurizes the demetallized resid feed to reduce the sulfur concentration in the demetallized resid stream by about 40 to about 100 wt % and typically about 65 to about 95 wt % to produce a desulfurized effluent stream exiting the second desulfurization reactor 76 in a desulfurized effluent line 78. The bulk of the desulfurization, however, does occur in the first stage hydrotreating unit 12.

Preferred reaction conditions in each of the first desulfurization reactor 74 and the second desulfurization reactor 76 include a temperature from about 66° C. (151° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig) to about 27.6 MPa (gauge) (4000 psig), preferably about 13.8 MPa (gauge) (2000 psig) to about 20.7 MPa (gauge) (3000 psig), a liquid hourly space velocity of the fresh resid feed from about 0.1 $hr^{-1}$ to about 5 $hr^{-1}$, preferably from about 0.2 to about 2 $hr^{-1}$, and a hydrogen rate of about 168 $Nm^3/m^3$ (1,000 scf/bbl) to about 1,680 $Nm^3/m^3$ oil (10,000 scf/bbl), preferably about 674 $Nm^3/m^3$ oil (4,000 scf/bbl) to about 1,011 $Nm^3/m^3$ oil (6,000 scf/bbl).

The second stage desulfurized resid stream may exit the second desulfurization reactor 74 in the desulfurized effluent line 78, be cooled by heat exchange perhaps with the first stage hydrogen stream in line 24 (not shown) and enter the second stage separation section 18 comprising a second stage hot separator 80. The second stage separation section 18 comprises one or more separators in downstream communication with the second hydrotreating unit 16 including the second stage hot separator 80. The first desulfurized effluent line 78 delivers a cooled desulfurized effluent stream to the second stage hot separator 80. Accordingly, the second stage hot separator 80 is in downstream communication with the first desulfurization reactor 74 and the second desulfurization reactor 76.

The second stage hot separator 80 separates the desulfurized effluent stream to provide a hydrocarbonaceous, second stage vapor stream in a second hot overhead line 82 and a hydrocarbonaceous, second stage hot liquid stream in a second hot bottoms line 84. The second stage hot separator 80 may operate at about 177° C. (350° F.) to about 371° C. (700° F.) and preferably operates at about 232° C. (450° F.) to about 315° C. (600° F.). The second stage hot separator 80 may be operated at a slightly lower pressure than the second desulfurization reactor 76 accounting for pressure drop through intervening equipment. The second stage hot separator 38 may be operated at pressures between about 3.4 MPa (gauge) (493 psig) and about 20.4 MPa (gauge) (2959 psig). The hydrocarbonaceous, the second stage vapor stream in the second hot overhead line 82 may have a temperature of the operating temperature of the second stage hot separator 80. The second stage hot liquid stream in the second hot bottoms line 84 may be fed to a hot flash drum 86.

The second stage hot vapor stream in the second hot overhead line 82 may be cooled by heat exchange before entering a second stage cold separator 88. The second stage cold separator 88 is in downstream communication with the hot overhead line 82 of the second stage hot separator 80. At a characteristic sublimation temperature, ammonia and hydrogen sulfide in the second hot overhead line 82 will combine to form ammonium bisulfide and ammonia, and chlorine will combine to form ammonium chloride. To prevent deposition of ammonium bisulfide or ammonium chloride salts in the second hot overhead line 82 transporting the second hot vapor stream, a suitable amount of wash water may be introduced into the second hot overhead line 82 by a second water wash line 90.

The second stage hot vapor stream may be separated in the second stage cold separator 88 to provide a second stage cold vapor stream which becomes the first stage hydrogen stream comprising a hydrogen-rich gas stream including ammonia and hydrogen sulfide in a second cold overhead line 92 and a second stage cold liquid stream in a second cold bottoms line 72. The second stage cold separator 88 serves to separate hydrogen rich gas from hydrocarbon liquid in the second stage hot vapor stream into the second stage cold vapor stream for recycle to the first stage hydrotreating unit 12 in second cold overhead line 92. The second stage cold vapor stream rich in hydrogen can be compressed in a compressor 94 for recycle as the first stage hydrogen stream in the first hydrogen line 24. Accordingly, the first stage hydrogen stream in the first hydrogen lien 24 may be taken from the second stage vapor stream in second stage hot overhead line 82 and the second stage cold vapor stream in the second stage cold overhead line 92. In an aspect, the water stream is pumped into the first stage hydrogen stream in line 24 from the water feed line 28, mixed therewith and heated with the first stage hydrogen stream in one or more heat exchangers before it is mixed with the resid feed stream 20.

The second stage cold separator 88 may be operated at about 100° F. (38° C.) to about 150° F. (66° C.), suitably about 115° F. (46° C.) to about 145° F. (63° C.), and just below the pressure of the second desulfurization reactor 76 and the second stage hot separator 80 accounting for pressure drop through intervening equipment to keep hydrogen and light gases in the overhead and normally liquid hydrocarbons in the bottoms. The second stage cold separator 88 may be operated at pressures between about 3 MPa (gauge) (435 psig) and about 20 MPa (gauge) (2,901 psig). The second stage cold separator 88 may also have a boot for collecting an aqueous phase. The second stage cold liquid stream in the second cold bottoms line 72 may have a temperature of the operating temperature of the cold separator 88. The second stage cold liquid stream in the second cold bottoms line 72 may be delivered to the cold flash drum 70 and be separated together in the cold flash drum 70. In an embodiment the second stage cold liquid stream in the second cold liquid bottoms line 72 may be mixed with the first stage cold liquid stream in the first cold bottoms line 50 and be separated together in the cold flash drum 70.

The hydrocarbonaceous second hot liquid stream in the second hot bottoms line 84 may be sent to fractionation. In an aspect, the second hot liquid stream in the second hot bottoms line 84 may be let down in pressure and flashed in a hot flash drum 86 to provide a hot flash vapor stream of light ends in a hot flash overhead line 94 and a hot flash liquid stream in a hot flash bottoms line 96. The hot flash drum 86 may be in direct, downstream communication with the second hot bottoms line 84 and in downstream communication with the second hydrotreating unit 16. In an aspect, the hot flash liquid stream in the flash hot bottoms line 96 may be forwarded to product fractionation which may be preceded by stripping to remove hydrogen sulfide from product streams including a desulfurized resid stream. Accordingly, a stripping column and a fractionation column may be in downstream communication with the hot flash drum 86 and the hot flash bottoms line 96.

The hot flash drum 86 may be operated at the same temperature as the second hot separator 80 but at a lower pressure of between about 1.4 MPa (gauge) (200 psig) and about 6.9 MPa (gauge) (1000 psig), suitably no more than about 3.8 MPa (gauge) (550 psig). The flash hot liquid stream in the flash hot bottoms line 96 may have a temperature of the operating temperature of the hot flash drum 86.

In an aspect, the second cold liquid stream in the second cold bottoms line 72 may be sent to fractionation. In a further aspect, the second cold liquid stream may be let down in pressure and flashed in a cold flash drum 70 to separate fuel gas from the second cold liquid stream in the second cold bottoms line 72 and provide a cold flash liquid stream in a cold flash bottoms line 100. The cold flash drum 70 may be in direct downstream communication with the second cold bottoms line 72 of the cold separator 88. In a further aspect, the cold flash drum 70 may separate the first cold liquid stream in the first cold bottoms line 50 to provide a fuel gas stream in a cold flash overhead line 98 and a cold flash liquid stream in a cold flash bottoms line 100. In an aspect, the second cold liquid stream in the second cold bottoms line 72 and the first cold liquid stream in the first cold bottoms line 50 may be flash separated in the cold flash drum 70 together. The cold flash liquid stream in the cold flash bottoms line 100 may be sent to product fractionation which may be preceded by stripping to remove hydrogen sulfide from product streams including a desulfurized resid stream. Accordingly, a stripping column and a fractionation column may be in downstream communication with the cold flash drum 70 and the cold flash bottoms line 100.

The first cold liquid stream in the first cold bottoms line 50 and the second cold liquid stream in the second cold bottoms line 72 may enter into the cold flash drum 70 either together or separately. In an aspect, the first cold bottoms line 50 joins the second cold bottoms line 72 and feeds the cold flash drum 70 together.

The cold flash drum 70 may be operated at the same temperature as the second cold separator 88 but typically at a lower pressure of between about 1.4 MPa (gauge) (200 psig) and about 6.9 MPa (gauge) (1000 psig) and preferably between about 3.0 MPa (gauge) (435 psig) and about 3.8 MPa (gauge) (550 psig). A flashed aqueous stream may be removed from a boot of the cold flash drum 70. The flash cold liquid stream in the flash cold bottoms line 100 may have the same temperature as the operating temperature of the cold flash drum 70.

EXAMPLES

Experimentation was conducted to determine the improving effect of the subject process on desulfurization of a resid stream with steps of demetallation in Example 1 and desulfurization in Example 2. The feedstock was Arabian medium atmospheric resid having 36,000 wppm sulfur, 31 wppm nickel, 89 wppm vanadium and 13 wt % Conradson carbon residue. The apparatus involved three tubular down flow reactors. Reactor 1 was loaded with KFR-15 catalyst available from Albemarle designed for hydrodemetallation reaction. Reactor 2 was loaded with 53 wt % KFR-15 catalyst and 47 wt % 15 KFR-33 catalyst available from Albemarle also designed for hydrodemetallation reactions. Reactor 3 was loaded with KFR-70 catalyst available from Albemarle designed for hydrodesulphurization reactions. All reactors were also loaded with inert quartz in the catalyst bed as diluent to ensure uniform flow distribution.

Example 1

Example 1 consists of one pair of experiments conducted to determine effect of water injection. The same configuration was applied with hydrodemetallation and hydrodesulfurization catalysts using Reactor 1, Reactor 2 and Reactor 3 in series at the same temperature and weight hourly space velocity and with no interstage separation. The only difference was the feed to the demetallation reactor in Experiment 1B was injected with water while Experiment 1A had no water injection into the feed.

Table 1 shows the experimental conditions for the single stage example for Reactors 1, 2 and 3 using both HDM and HDS catalyst. Water rate is based on fresh feed weight. The temperature was the catalyst weight averaged temperature. The weight hourly space velocity was based on the weight of the hydrocarbon resid feed only.

TABLE 1

| | Experiment | |
|---|---|---|
| | 1A | 1B |
| Catalyst | HDM + HDS | HDM + HDS |
| Sulfur, wppm | 36000 | 36000 |
| Water rate, wt % | 0% | 5% |
| Temperature, ° F. (° C.) | 727 (386) | 727 (386) |

Example 2

Example 2 consisted of one pair of experiments conducted to determine a baseline hydrodemetallation performance using Reactor 1 and Reactor 2 only at the same temperature with and without water injection to exemplify the first demetallation stage. Products were collected to be used as demetallized feed for the second desulfurization stage.

Table 2 shows the experimental conditions for the first stage example for Reactors 1 and 2 using HDM catalyst only. The water rate was based on fresh feed weight. The temperature was the catalyst weight averaged temperature. The weight hourly space velocity was based on the weight of the hydrocarbon resid feed only.

TABLE 2

| | Experiment | |
|---|---|---|
| | 2A | 2B |
| Catalyst | HDM | HDM |
| Sulfur, wppm | 36000 | 36000 |
| Water rate, wt % | 0% | 5% |
| Temperature, ° F. (° C.) | 711 (377) | 711 (377) |

Example 3

Example 3 consisted of one pair of experiments conducted to determine a baseline hydrodemetallation performance using Reactor 1 and Reactor 2 only at a same temperature with and without water injection to exemplify the first demetallation stage. Products were collected to be used as demetallized feed for the second desulfurization stage. The key difference of Example 3 from Example 2 lies in the reactor temperatures.

Table 3 shows the experimental conditions for the first stage example for Reactors 1 and 2 using HDM catalyst only. The water rate was based on fresh feed weight. The temperature was the catalyst weight averaged temperature. The weight hourly space velocity was based on the weight of the hydrocarbon resid feed only.

TABLE 3

| | Experiment | |
|---|---|---|
| | 3A | 3B |
| Catalyst | HDM | HDM |
| Sulfur, wppm | 36000 | 36000 |
| Water rate, wt % | 0% | 5% |
| Temperature, ° F. (° C.) | 726 (386) | 726 (386) |

Example 4

Demetallized resid products from Example 2 were used as feed to the desulfurization stage of Example 4 to exemplify a process with and without interstage separation to remove hydrogen sulfide. To represent the two stage concept having a separation step, hydrogen sulfide concentration was reduced to 0 and the flow rate was reduced by 15 wt % to represent removal of the first stage vapor stream from the demetallized resid feed stream. Because the apparatus could not retain the vapor from the first stage, we added 3 vol % hydrogen sulfide to the feed to the second desulfurization stage to represent the base case without interstage vapor removal. Unisim simulation software was used to determine hydrogen sulfide concentrations and overall flow rates with and without interstage separation. To keep comparisons equivalent, we reduced the flow rate of feed in the water injection case with interstage separation to maintain space velocities equivalent. For the water injection with interstage separation case, the flow rate was reduced by 15 wt % similar to the interstage case.

Table 4 shows the conditions and results for the second desulfurization stage. The weight hourly space velocity was based on the liquid hydrocarbon fed to the second desulfurization stage only. The temperature was the catalyst weight averaged temperature. The sulfur concentration was in the liquid product.

TABLE 4

| | Experiment | | | |
|---|---|---|---|---|
| | 4A | 4B | 4C | 4D |
| Case | Base case | Remove vapor | $H_2O$ inject, keep vapor | $H_2O$ inject, remove vapor |
| Hydrogen Sulfide, vol % | 3 | 0 | 3 | 0 |
| Feed from first stage product | 2A | 2A | 2B | 2B |
| WHSV, 1/hr | 0.63 | 0.55 | 0.55 | 0.55 |
| Temperature, ° F. (° C.) | 740 (393) | 740 (393) | 740 (393) | 740 (393) |
| Sulfur in product, wppm | 4245 | 3029 | 3395 | 2375 |

Example 5

Similar to Example 4, demetallized resid products from Example 3 were used as feed to the desulfurization stage of Example 5 to exemplify a process with and without interstage separation to remove hydrogen sulfide. To represent the two stage concept having a separation step, hydrogen sulfide concentration was reduced to 0 and the flow rate was reduced by 15 wt % to represent removal of the first stage vapor stream from the demetallized resid feed stream. Because the apparatus could not retain the vapor from the first stage, we added 3 vol % hydrogen sulfide to the feed to the second desulfurization stage to represent the base case without interstage vapor removal. Unisim simulation software was used to determine hydrogen sulfide concentration and overall flow rates with and without interstage separation. To keep comparisons equivalent, we reduced the flow rate of feed in the water injection case with interstage separation to maintain space velocities equivalent. For the water injection with interstage separation case, the flow rate was reduced by 15 wt % similar to the interstage case.

Table 5 shows the conditions and results for the second desulfurization stage. The weight hourly space velocity was based on the liquid hydrocarbon fed to the second desulfurization stage only. The temperature was the catalyst weight averaged temperature. The sulfur concentration was in the liquid product.

TABLE 5

| | Experiment | | | |
|---|---|---|---|---|
| | 5A | 5B | 5C | 5D |
| Case | Base case | Remove vapor | $H_2O$ inject, keep vapor | $H_2O$ inject, remove vapor |
| Hydrogen Sulfide, vol % | 3 | 0 | 3 | 0 |
| Product from first stage | 3A | 3A | 3B | 3B |
| WHSV, 1/hr | 0.63 | 0.55 | 0.55 | 0.55 |
| Temperature, ° F. (° C.) | 740 (393) | 740 (393) | 740 (393) | 740 (393) |
| Sulfur in product, wppm | 3865 | 2556 | 3300 | 2100 |

Tables 6, 7 and 8 summarize desulphurization rate constant calculations using Formula 1 for the results from Tables 1, 4 and 5:

$$k = \frac{\left[\frac{1}{(\text{Sulfur content in product})^{n-1}} - \frac{1}{(\text{Sulfur content in feed})^{n-1}}\right] \times WHSV}{\text{Exp}\left(E/R * \left(\frac{1}{700} - \frac{1}{460 + \text{Temp}}\right)\right)} a. \quad (1)$$

In Formula 1, "k" is the rate constant. "WHSV" is weight hourly space velocity based on the liquid hydrocarbon fed to the first demetallation stage and the second desulfurization stage. "Temp" is averaged reactor temperature in ° F. taken over both stages. Sulfur content is applied as $36000/1\times10^6$ when in terms of wppm. "E/R" is an activation term equaling the activation energy for hydrodesulfurization over the gas constant. We have taken E/R as 22,000 with 700° F. as a reference temperature.

Table 6 calculates the reaction rate constant from the data of Example 1.

TABLE 6

| | Base case | Water injection only |
|---|---|---|
| Sulfur content in feed, wppm | 36000 | 36000 |
| Sulfur content in liquid product, wppm | 3895 | 3409 |
| Temperature, ° F. (° C.) | 727 (386) | 727 (386) |
| WHSV, 1/hr | 0.34 | 0.34 |
| Activation energy term, E/R, cal/mol | 22000 | 22000 |
| Desulfurization reaction order, n | 2 | 2 |
| Rate constant, k, 1/hr | 50.6 | 58.6 |
| Improvement Delta | 0 | 8.0 |

The rate constant, k, indicates how fast organic sulfur is converted to hydrogen sulfide and hydrocarbon. The improvement in the rate constant for water injected into the demetallation stage is shown as 8 1/hr.

Table 7 calculates the reaction rate constant for the data from related Examples 2 and 4.

TABLE 7

| | Base case | Two stage with vapor removal | Water injection only | Water injection and two stage with vapor removal |
|---|---|---|---|---|
| Sulfur content in feed, wppm | 36000 | 36000 | 36000 | 36000 |
| Sulfur content in liquid product, wppm | 4245 | 3029 | 3395 | 2375 |
| Temperature, ° F. (° C.) | 727 (386) | 727 (386) | 727 (386) | 727 (386) |
| WHSV, 1/hr | 0.34 | 0.31 | 0.31 | 0.31 |
| Activation energy term, E/R, cal/mol | 22000 | 22000 | 22000 | 22000 |
| Desulfurization reaction order, n | 2 | 2 | 2 | 2 |
| Rate constant, k, 1/hr | 46 | 62 | 54.7 | 81 |
| Improvement Delta | 0 | 16 | 8.7 | 35 |

The rate constant, k, indicates how fast organic sulfur is converted to hydrogen sulfide and hydrocarbon. The improvement in the rate constant for water injected into the demetallation stage followed by removal of hydrogen sulfide before the desulfurization stage is greater than the improvement in the individual rate constant for each of water injection and hydrogen sulfide removal by 42% for Examples 2 and 4. Therefore, water injection into the demetallation stage followed by removal of hydrogen sulfide before the desulfurization stage provides an unexpected synergetic effect.

Table 8 calculates the reaction rate constant from the data from related Examples 3 and 5.

TABLE 8

| | Base case | Two stage with vapor removal | Water injection only | Water injection and two stage with vapor removal |
|---|---|---|---|---|
| Sulfur content in feed, wppm | 36000 | 36000 | 36000 | 36000 |
| Sulfur content in liquid product, wppm | 3865 | 2556 | 3300 | 2100 |
| Temperature, ° F. (° C.) | 734 (390) | 734 (390) | 734 (390) | 734 (390) |
| WHSV, 1/hr | 0.34 | 0.31 | 0.31 | 0.31 |

TABLE 8-continued

| | Base case | Two stage with vapor removal | Water injection only | Water injection and two stage with vapor removal |
|---|---|---|---|---|
| Activation energy term, E/R, cal/mol | 22000 | 22000 | 22000 | 22000 |
| Desulfurization reaction order, n | 2 | 2 | 2 | 2 |
| Rate constant, k, 1/hr | 45.7 | 66.8 | 50.6 | 82.4 |
| Improvement Delta | 0 | 21.1 | 4.9 | 36.7 |

The improvement in the rate constant for water injected into the demetallation stage followed by removal of hydrogen sulfide before the desulfurization stage is greater than the improvement in the individual rate constant for each of water injection and hydrogen sulfide removal by 41% for Examples 3 and 5. Therefore, water injection into the demetallation stage followed by removal of hydrogen sulfide before the desulfurization stage provides an unexpected synergetic effect in both data from pairs of Examples 2 and 4, and Examples 3 and 5.

Specific Embodiments

While the following is described in conjunction with specific embodiments, it will be understood that this description is intended to illustrate and not limit the scope of the preceding description and the appended claims.

A first embodiment of the invention is a process for hydrotreating a hydrocarbon resid stream comprising adding a water stream and a first stage hydrogen stream to a resid stream; hydrotreating the resid stream over a demetallation catalyst to demetallize the resid stream in the presence of the first stage hydrogen stream to provide a demetallized resid stream reduced in metals and sulfur concentration; separating the demetallized resid stream into a first stage vapor stream comprising hydrogen sulfide and a first stage liquid stream with a smaller concentration of hydrogen sulfide than in the demetallized resid stream; adding a second stage hydrogen stream to the first stage liquid stream; hydrotreating the first stage liquid stream over a desulfurization catalyst and the second stage hydrogen stream to provide a desulfurized resid stream. An embodiment of the invention is one, any or all of prior embodiments in this paragraph up through the first embodiment in this paragraph further comprising adding the water stream to the first stage hydrogen stream before they are added to the resid stream. An embodiment of the invention is one, any or all of prior embodiments in this paragraph up through the first embodiment in this paragraph further comprising heating the water stream and the first stage hydrogen stream while the water stream is in the first stage hydrogen stream. An embodiment of the invention is one, any or all of prior embodiments in this paragraph up through the first embodiment in this paragraph further comprising separating the desulfurized resid stream to provide a second stage vapor stream and a second stage liquid stream and taking the first stage hydrogen stream from the second stage vapor stream. An embodiment of the invention is one, any or all of prior embodiments in this paragraph up through the first embodiment in this paragraph further comprising separating the second stage vapor stream into the first stage hydrogen stream and a second stage cold liquid stream. An embodiment of the invention is one, any or all of prior embodiments in this paragraph up through the first embodiment in this paragraph further comprising compressing the first stage hydrogen stream prior to the addition of the water stream and heating the first stage hydrogen stream. An embodiment of the invention is one, any or all of prior embodiments in this paragraph up through the first embodiment in this paragraph further comprising separating the first stage vapor stream into a first stage cold vapor stream and a first stage cold liquid stream. An embodiment of the invention is one, any or all of prior embodiments in this paragraph up through the first embodiment in this paragraph further comprising separating the first stage cold liquid stream and the second stage cold liquid stream to provide a fuel gas stream and a cold flash liquid stream. An embodiment of the invention is one, any or all of prior embodiments in this paragraph up through the first embodiment in this paragraph further comprising separating the second stage liquid stream to provide a hot flash vapor stream and a hot flash liquid stream. An embodiment of the invention is one, any or all of prior embodiments in this paragraph up through the first embodiment in this paragraph further comprising fractionating the hot flash liquid stream and the cold flash liquid stream. An embodiment of the invention is one, any or all of prior embodiments in this paragraph up through the first embodiment in this paragraph further comprising separating the first stage cold liquid stream with the second stage cold liquid stream and to provide the fuel gas stream and the cold flash liquid stream. An embodiment of the invention is one, any or all of prior embodiments in this paragraph up through the first embodiment in this paragraph further comprising taking the second stage hydrogen stream from the first stage cold vapor stream. An embodiment of the invention is one, any or all of prior embodiments in this paragraph up through the first embodiment in this paragraph further comprising hydrotreating the resid stream over a demetallation catalyst in multiple reactors operated in which one reactor receives feed while the other reactor does not receive feed while catalyst therein is being replaced or regenerated A second embodiment of the invention is a process for hydrotreating a hydrocarbon resid stream comprising mixing a water stream and a first stage hydrogen stream; heating the mixed water stream and first stage hydrogen stream; adding the heated mixed water stream and the first stage hydrogen stream to a resid stream; hydrotreating the resid stream over a demetallation catalyst to demetallize the resid stream in the presence of the first stage hydrogen stream to provide a demetallized resid stream reduced in metals and sulfur concentration; separating the demetallized resid stream into a first stage vapor stream comprising hydrogen sulfide and a first stage liquid stream with a smaller concentration of hydrogen sulfide than in the demetallized resid stream; adding a second stage hydrogen stream to the first stage liquid stream; hydrotreating the first stage liquid stream over a desulfurization catalyst and the second stage hydrogen stream to provide a desulfurized resid stream. An embodiment of the invention is one, any or all of prior embodiments in this paragraph up through the second embodiment in this paragraph further comprising separating the desulfurized resid stream to provide a second stage vapor stream and a second stage liquid stream and taking the first stage hydrogen stream from the second stage vapor stream. An embodiment of the invention is one, any or all of prior embodiments in this paragraph up through the second embodiment in this paragraph further comprising separating the second stage vapor stream into the first stage hydrogen stream and a second stage cold liquid stream. An embodiment of the invention is one, any or all of prior embodiments in this paragraph up through the second embodiment in this paragraph further comprising compressing the first stage hydrogen stream prior to the addition of the water stream and heating the first stage hydrogen stream.

A third embodiment of the invention is a process for hydrocracking a hydrocarbon resid stream comprising adding a water stream and a first stage hydrogen stream to a resid stream; hydrotreating the resid stream over a demetallation catalyst to demetallize the resid stream in the presence of the first stage hydrogen stream to provide a demetallized resid stream reduced in metals and sulfur concentration; separating the demetallized resid stream into a first stage vapor stream comprising hydrogen sulfide and a first stage liquid stream with a smaller concentration of hydrogen sulfide than in the demetallized resid stream; adding a second stage hydrogen stream to the first stage liquid stream; hydrotreating the first stage liquid stream over a desulfurization catalyst and the second stage hydrogen stream to provide a desulfurized resid stream; separating the desulfurized resid stream to provide a second stage vapor stream and a second stage liquid stream and taking the first stage hydrogen stream from the second stage vapor stream. An embodiment of the invention is one, any or all of prior embodiments in this paragraph up through the third embodiment in this paragraph further comprising taking the second stage hydrogen stream from the first stage vapor stream. An embodiment of the invention is one, any or all of prior embodiments in this paragraph up through the third embodiment in this paragraph further comprising adding the water stream to the first stage hydrogen stream and heating the water stream and the first stage hydrogen stream while the water stream is in the first stage hydrogen stream before they are added to the resid stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for hydrotreating a hydrocarbon resid stream comprising:

adding a water stream and a first stage hydrogen stream to a resid stream; hydrotreating said resid stream over a demetallation catalyst at a temperature of 343° C. (650° F.) to about 399° C. (750° F.) to demetallize said resid stream in the presence of the first stage hydrogen stream to provide a demetallized resid stream reduced in metals and sulfur concentration;

separating said demetallized resid stream into a first stage vapor stream comprising hydrogen sulfide and a first stage liquid stream with a smaller concentration of hydrogen sulfide than in the demetallized resid stream;

adding a second stage hydrogen stream to said first stage liquid stream;

hydrotreating said first stage liquid stream over a desulfurization catalyst and the second stage hydrogen stream to provide a desulfurized resid stream;

and separating said desulfurized resid stream to provide a second stage vapor stream and a second stage liquid stream and taking said first stage hydrogen stream from said second stage vapor stream.

2. The process of claim 1 further comprising adding said water stream to said first stage hydrogen stream before they are added to the resid stream.

3. The process of claim 2 further comprising heating said water stream and said first stage hydrogen stream while the water stream is in the first stage hydrogen stream.

4. The process of claim 1 further comprising separating said second stage vapor stream into said first stage hydrogen stream and a second stage cold liquid stream.

5. The process of claim 4 further comprising compressing said first stage hydrogen stream prior to the addition of the water stream and heating said first stage hydrogen stream.

6. The process of claim 4 further comprising separating said first stage vapor stream into a first stage cold vapor stream and a first stage cold liquid stream.

7. The process of claim 6 further comprising separating said first stage cold liquid stream and said second stage cold liquid stream to provide a fuel gas stream and a cold flash liquid stream.

8. The process of claim 7 further comprising separating said second stage liquid stream to provide a hot flash vapor stream and a hot flash liquid stream.

9. The process of claim 8 further comprising fractionating said hot flash liquid stream and said cold flash liquid stream.

10. The process of claim 6 further comprising separating said first stage cold liquid stream with said second stage cold liquid stream and to provide said fuel gas stream and said cold flash liquid stream.

11. The process of claim 6 further comprising taking said second stage hydrogen stream from said first stage cold vapor stream.

12. The process of claim 1 further comprising hydrotreating said resid stream over a demetallation catalyst in multiple reactors operated in which one reactor receives feed while the other reactor does not receive feed while catalyst therein is being replaced or regenerated.

13. A process for hydrotreating a hydrocarbon resid stream comprising:

mixing a water stream and a first stage hydrogen stream;

heating said mixed water stream and first stage hydrogen stream;

adding said heated mixed water stream and said first stage hydrogen stream to a resid stream;

hydrotreating said resid stream over a demetallation catalyst to demetallize said resid stream in the presence of the first stage hydrogen stream to provide a demetallized resid stream reduced in metals and sulfur concentration;

separating said demetallized resid stream into a first stage vapor stream comprising hydrogen sulfide and a first stage liquid stream with a smaller concentration of hydrogen sulfide than in the demetallized resid stream;

adding a second stage hydrogen stream to said first stage liquid stream;

hydrotreating said first stage liquid stream over a desulfurization catalyst and the second stage hydrogen stream to provide a desulfurized resid stream; and separating said desulfurized resid stream to provide a second stage vapor stream and a second stage liquid stream and taking said first stage hydrogen stream from said second stage vapor stream.

14. The process of claim 13 further comprising separating said second stage vapor stream into said first stage hydrogen stream and a second stage cold liquid stream.

15. The process of claim 14 further comprising compressing said first stage hydrogen stream prior to the addition of the water stream and heating said first stage hydrogen stream.

16. A process for hydrocracking a hydrocarbon resid stream comprising:

adding a water stream and a first stage hydrogen stream to a resid stream;

hydrotreating said resid stream over a demetallation catalyst to demetallize said resid stream in the presence of the first stage hydrogen stream to provide a demetallized resid stream reduced in metals and sulfur concentration;

separating said demetallized resid stream into a first stage vapor stream comprising hydrogen sulfide and a first stage liquid stream with a smaller concentration of hydrogen sulfide than in the demetallized resid stream;

adding a second stage hydrogen stream to said first stage liquid stream;

hydrotreating said first stage liquid stream over a desulfurization catalyst and the second stage hydrogen stream to provide a desulfurized resid stream; and separating said desulfurized resid stream to provide a second stage vapor stream and a second stage liquid stream and taking said first stage hydrogen stream from said second stage vapor stream.

17. The process of claim 16 further comprising taking said second stage hydrogen stream from said first stage vapor stream.

18. The process of claim 17 further comprising adding said water stream to said first stage hydrogen stream and heating said water stream and said first stage hydrogen stream while the water stream is in the first stage hydrogen stream before they are added to the resid stream.

* * * * *